US011149391B2

(12) United States Patent
Weissberg et al.

(10) Patent No.: US 11,149,391 B2
(45) Date of Patent: Oct. 19, 2021

(54) DEVICE FOR PROTECTION FROM TRUCK RAMMING ATTACKS

(71) Applicant: PITAGONE, Brussels (BE)

(72) Inventors: Marc Weissberg, Brussels (BE); Shimon Bretholz, Kfar Saba (IL)

(73) Assignee: PITAGONE, Brussels (BE)

( * ) Notice: Subject to any disclaimer, the term of this patent is extended or adjusted under 35 U.S.C. 154(b) by 0 days.

(21) Appl. No.: 16/496,379

(22) PCT Filed: Mar. 19, 2018

(86) PCT No.: PCT/EP2018/056798
§ 371 (c)(1),
(2) Date: Sep. 20, 2019

(87) PCT Pub. No.: WO2018/172238
PCT Pub. Date: Sep. 27, 2017

(65) Prior Publication Data
US 2020/0378078 A1 Dec. 3, 2020

(30) Foreign Application Priority Data
Mar. 21, 2017 (BE) ..... 2017/5173

(51) Int. Cl.
*E01F 13/12* (2006.01)
*F41H 11/08* (2006.01)

(52) U.S. Cl.
CPC ..... *E01F 13/12* (2013.01); *F41H 11/08* (2013.01)

(58) Field of Classification Search
CPC ..... E01F 13/12; E01F 15/146; E01F 15/148; F41H 11/08
See application file for complete search history.

(56) References Cited

U.S. PATENT DOCUMENTS 5,549,410 A * 8/1996 Beryozkin ..... E01F 13/12 404/6
5,775,832 A * 7/1998 Kilgrow ..... E01F 13/12 404/6
10,415,198 B1 * 9/2019 Thomas ..... E01F 13/02
10,724,191 B2 * 7/2020 Pan ..... G05D 1/0011
(Continued)

FOREIGN PATENT DOCUMENTS

CH 203717 A * 3/1939 ..... F41H 11/08
CH 446125 A 10/1967
(Continued)

OTHER PUBLICATIONS

Jul. 3, 2018, International Search Report and Written Opinion from the European Patent Office in PCT/EP2018/056798, which is the international application to this application.

*Primary Examiner* — Thomas B Will
*Assistant Examiner* — Katherine J Chu
(74) *Attorney, Agent, or Firm* — Kolitch Romano LLP

(57) ABSTRACT

An anti-ramming truck device may include at least one substantially horizontal arresting bar, at least one pivot bar. The pivot bar(s) and arresting bar(s) form, in a vertical plane, an angle of at least 100°. Each arresting bar is rigidly connected to a corresponding pivot bar. The arresting bar(s) are removably fitted into connectors, into which the pivot bar(s) are removably fitted. The connectors maintain a fixed angle of greater than 100° between the arresting bar(s) and the pivot bar(s).

17 Claims, 9 Drawing Sheets

(56) References Cited

U.S. PATENT DOCUMENTS

| | | | | |
|---|---|---|---|---|
| 2010/0290833 | A1* | 11/2010 | Whitford | F41H 11/08 404/6 |
| 2012/0177439 | A1* | 7/2012 | More | E01F 13/12 404/6 |
| 2014/0161523 | A1* | 6/2014 | Ball | E01F 13/06 404/6 |
| 2017/0204575 | A1* | 7/2017 | Klein | E01F 13/12 |
| 2020/0063387 | A1* | 2/2020 | Klein | E01F 13/022 |
| 2020/0173121 | A1* | 6/2020 | Klein | E01F 13/12 |

FOREIGN PATENT DOCUMENTS

| | | | | | |
|---|---|---|---|---|---|
| CN | 106468049 | A | | 3/2017 | |
| EP | 3323942 | A1 | | 5/2018 | |
| EP | 3378992 | B1 | * | 10/2019 | F41H 11/08 |
| EP | 3575493 | A1 | * | 12/2019 | E01F 13/12 |
| FR | 858076 | A | * | 11/1940 | F41H 11/08 |
| FR | 3082532 | A1 | * | 12/2019 | E01F 13/12 |
| WO | WO-2018172238 | A1 | * | 9/2018 | E01F 13/12 |

* cited by examiner

DEVICE FOR PROTECTION FROM TRUCK RAMMING ATTACKS

FIELD

The present disclosure relates to lightweight barriers for protection from terrorist truck ramming attacks.

BACKGROUND

Recent years have seen an increase in terrorist attacks in the West. This surge in terrorist acts has also been marked by a diversification in the means used in Europe, with the emergence in particular of the use of heavy goods vehicles as a weapon of terror.

There are heavy barriers that can reduce the risk of this type of attack, such as concrete barriers or metal posts securely anchored to the ground. However, this type of barrier requires either permanent installation or heavy logistics implying the use of a lifting device. This limitation is particularly acute with regard to securing temporary events, festivals, commercial fairs, concerts, etc. Furthermore, these temporary events appear to have today become favourite targets for terrorists.

One solution to this problem is provided for example by document US 2012/0177439 which proposes a lightweight barrier that can be set up, positioned and dismantled by just a few people having little in the way of tools and no lifting device. However, although these barriers are effective against lightweight vehicles, experience shows that they are not adequate to stop heavy vehicles such as those used recently by terrorists.

SUMMARY

The present disclosure aims to propose a device for protection from attacks using heavy goods vehicles, which device should be lightweight and easy to use by law enforcement having little in the way of tools.

The present disclosure relates to an anti-ramming truck device comprising:

at least one essentially horizontal arresting bar;

at least one pivot bar forming, with the arresting bar(s), an angle of at least 100° in a vertical plane, each arresting bar being rigidly connected to a corresponding pivot bar.

According to preferred embodiments, the anti-ramming truck device comprises one or an appropriate combination of several of the following features:

the device comprises anchoring means or mechanisms comprising essentially vertical spikes that are able to penetrate the surface of the ground when the wheel of a truck presses on an arresting bar;

the device comprises additional anchoring means or mechanisms comprising a spike that is able to penetrate the surface of the ground when the device pivots as a consequence of a truck hitting a pivot bar;

the pivot bars form an angle of between 100 and 135° with respect to the arresting bars;

the arresting bars, when the device is set up on a flat horizontal surface, are slightly inclined, the pivot bars forming an angle of at least 100° with respect to the horizontal, the inclination being preferably obtained by way of supports located close to the centre of gravity of the arresting bar/pivot bar assembly or assemblies so as to facilitate pivoting of the assemblies;

the arresting bars are removably fitted into connectors into which the pivot bars are removably fitted, the connectors maintaining, in use, a fixed angle of greater than 100° between the arresting bars and the pivot bars;

multiple arresting bar/connector/pivot bar assemblies are arranged parallel to one another and are connected to one another by way of crossbars.

A second aspect relates to a kit for setting up an anti-ramming truck device according to the present disclosure, comprising:

n arresting bars, n being an integer greater than 1;

n pivot bars;

n connectors into which the arresting bars and the pivot bars fit;

(n−1)*3 crossbars for fixing adjacent bars and connectors.

Advantageously, the arresting bars and the pivot bars are interchangeable.

Preferably, the connectors comprise two hollow metal arms to allow the arresting bars and pivot bars to be fitted, the two hollow arms being welded to one another at an angle of greater than 100°.

Advantageously, the metal arms have square cross sections arranged such that the diagonal of the square cross sections is vertical, which on the one hand improves their mechanical strength and on the other hand minimizes the probability of the arresting bars being blocked by a wheel.

To improve the mechanical strength of the system, the connectors preferably comprise a strut or a gusset plate strengthening said connectors.

DETAILED DESCRIPTION

Figure 1:
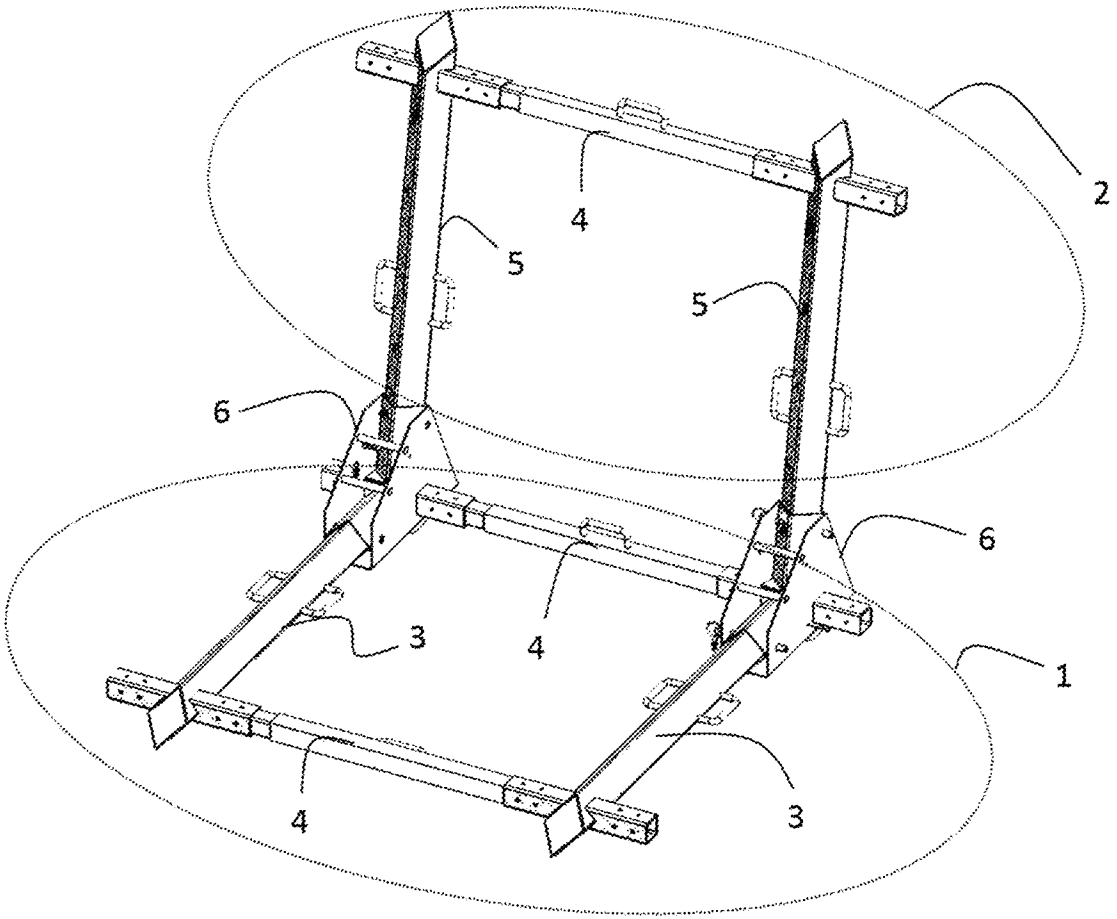
FIG. 1 shows a perspective view of an exemplary barrier according to the present disclosure.
Figure 2:
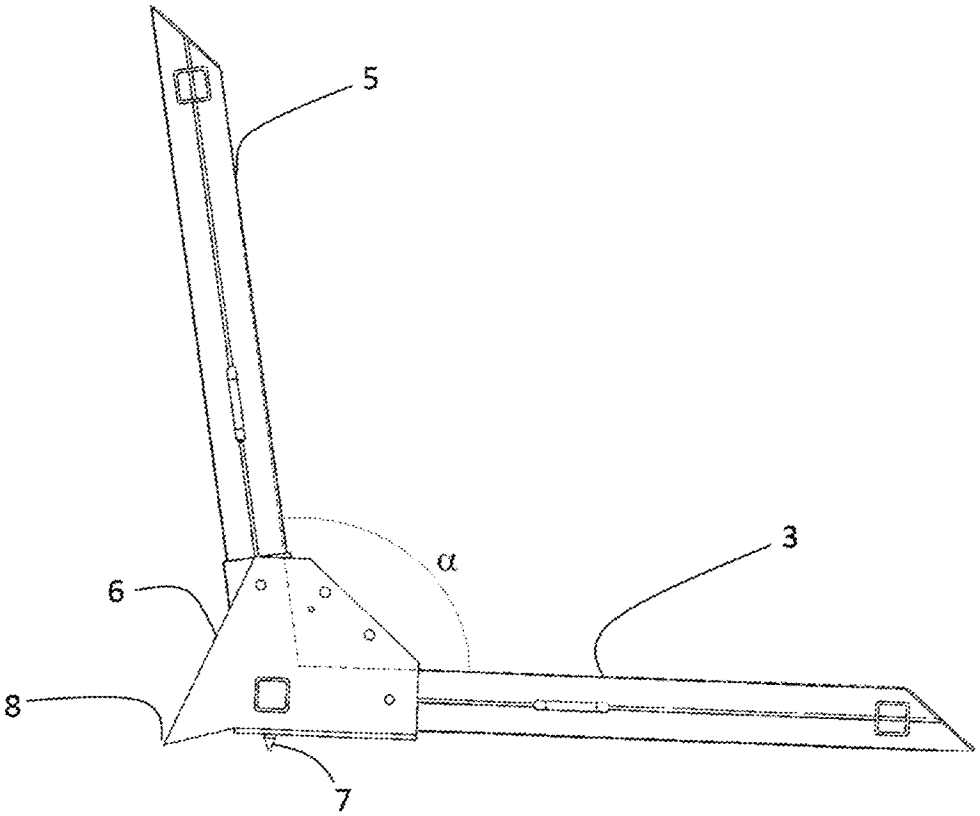
FIG. 2 shows a side view of the exemplary barrier of FIG. 1.
Figure 3:
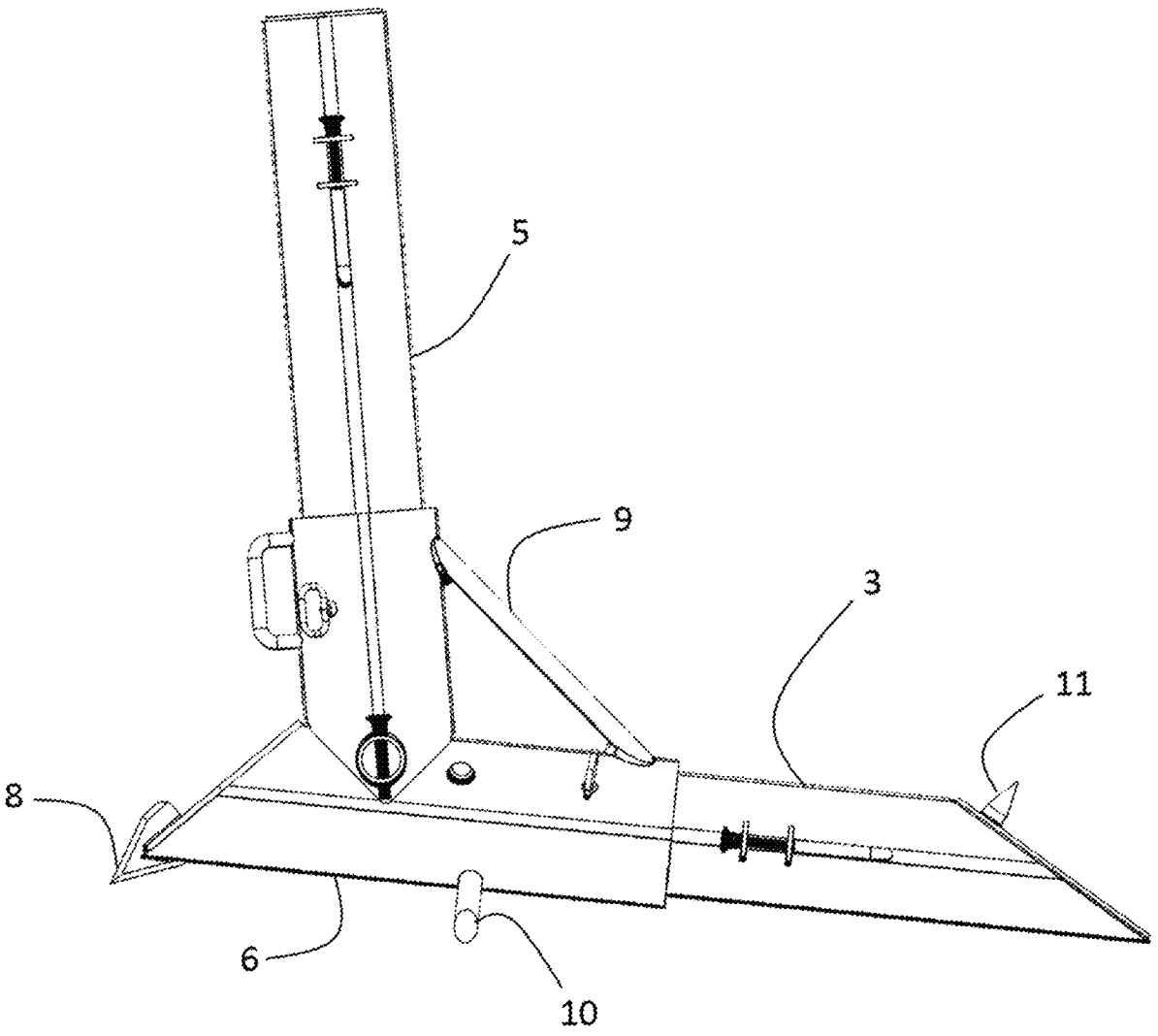
FIG. 3 shows a side view of a preferred example of the present disclosure.
Figure 4:
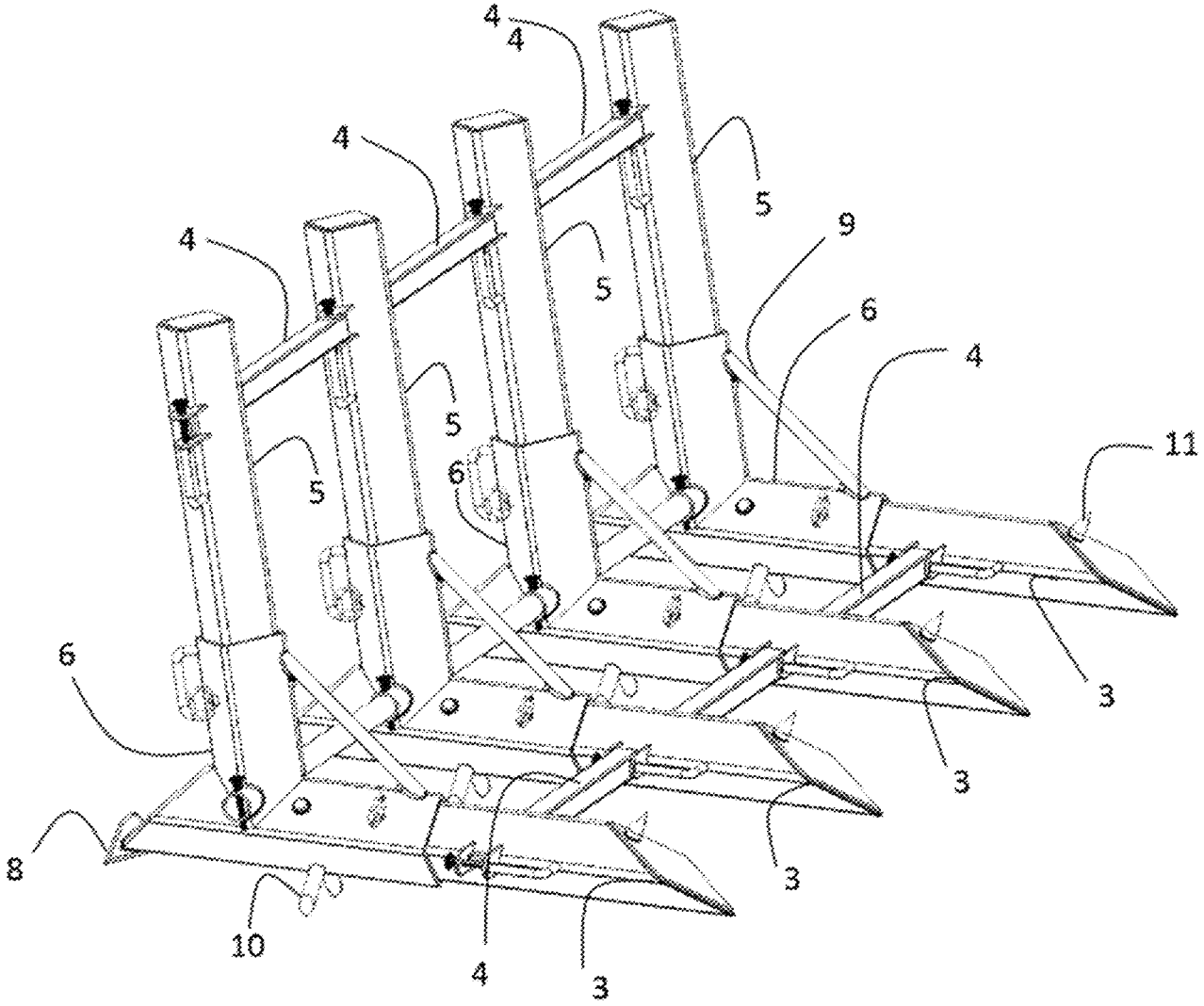
FIG. 4 shows a perspective view of the example of FIG. 3.
Figure 5:
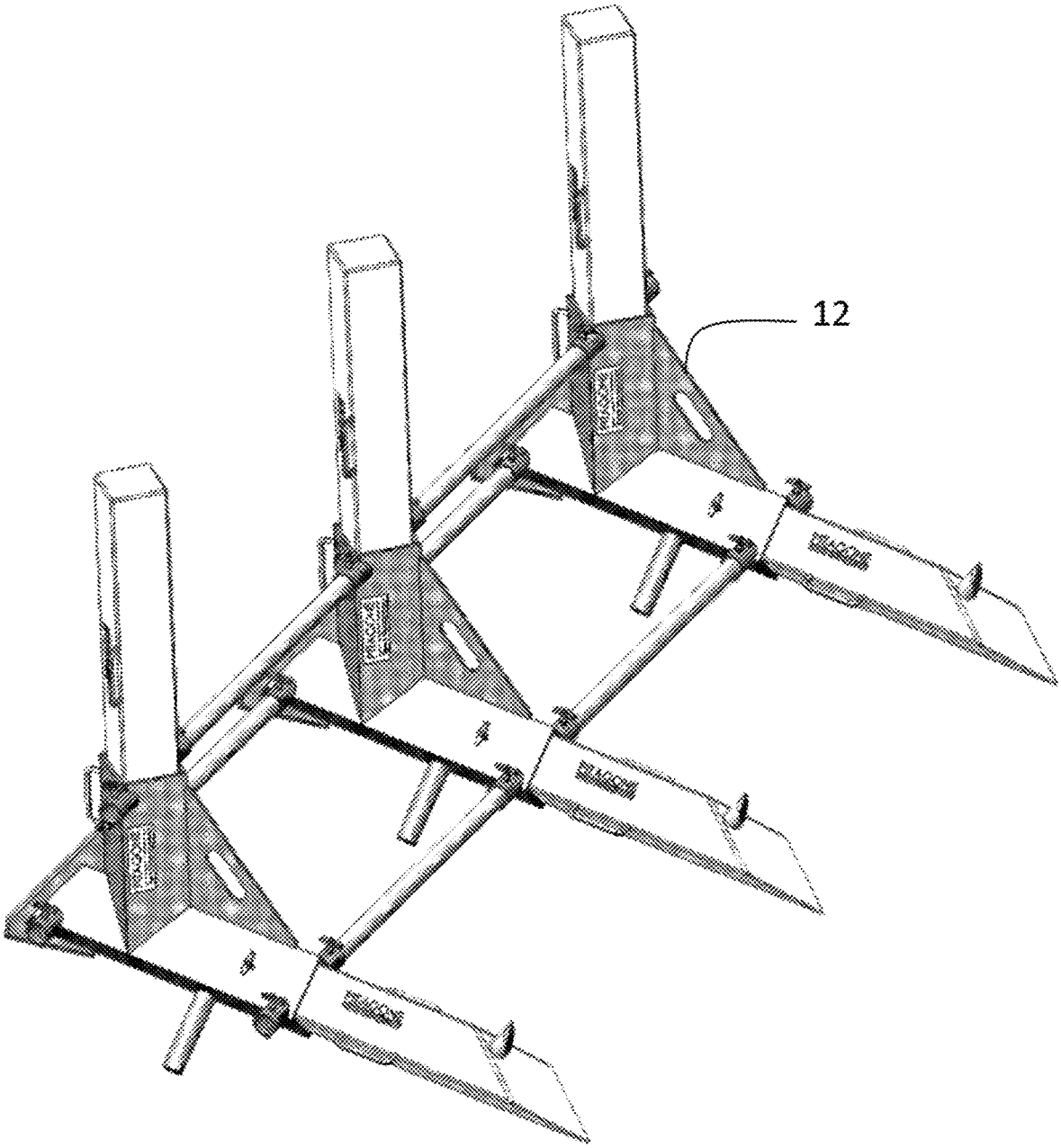
FIG. 5 shows a side view of another preferred example of the present disclosure.
Figure 6:
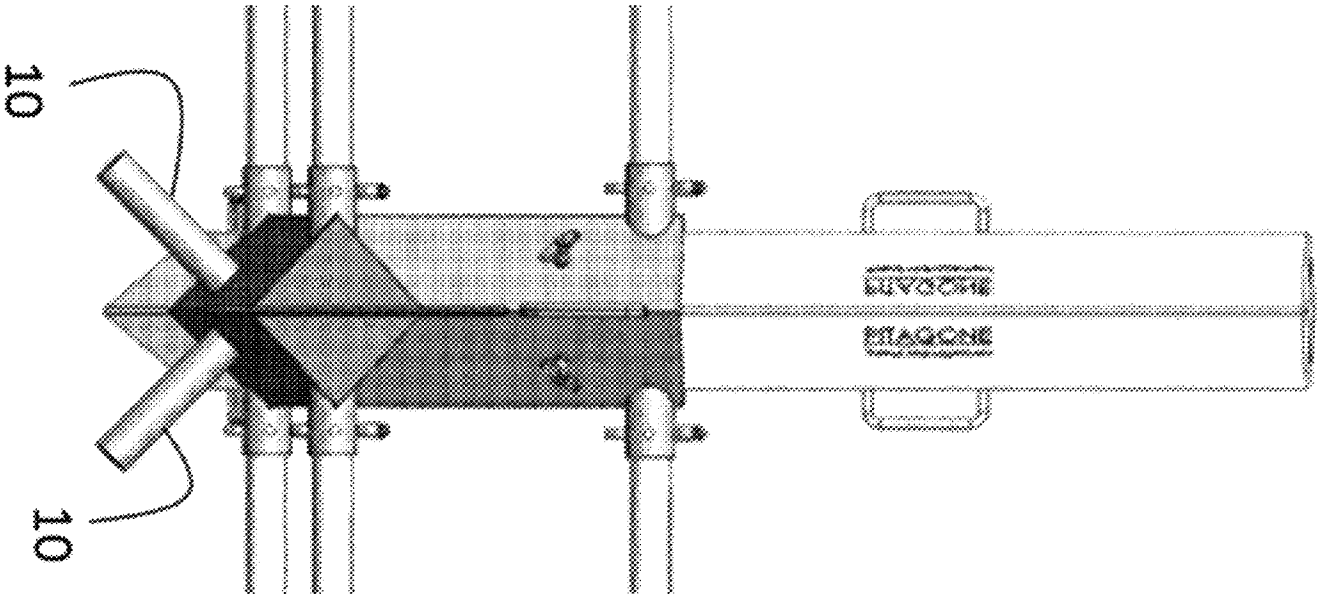
FIG. 6 shows a view of the rear face of an arresting bar/connector/pivot bar assembly according to the present disclosure.
Figure 7:
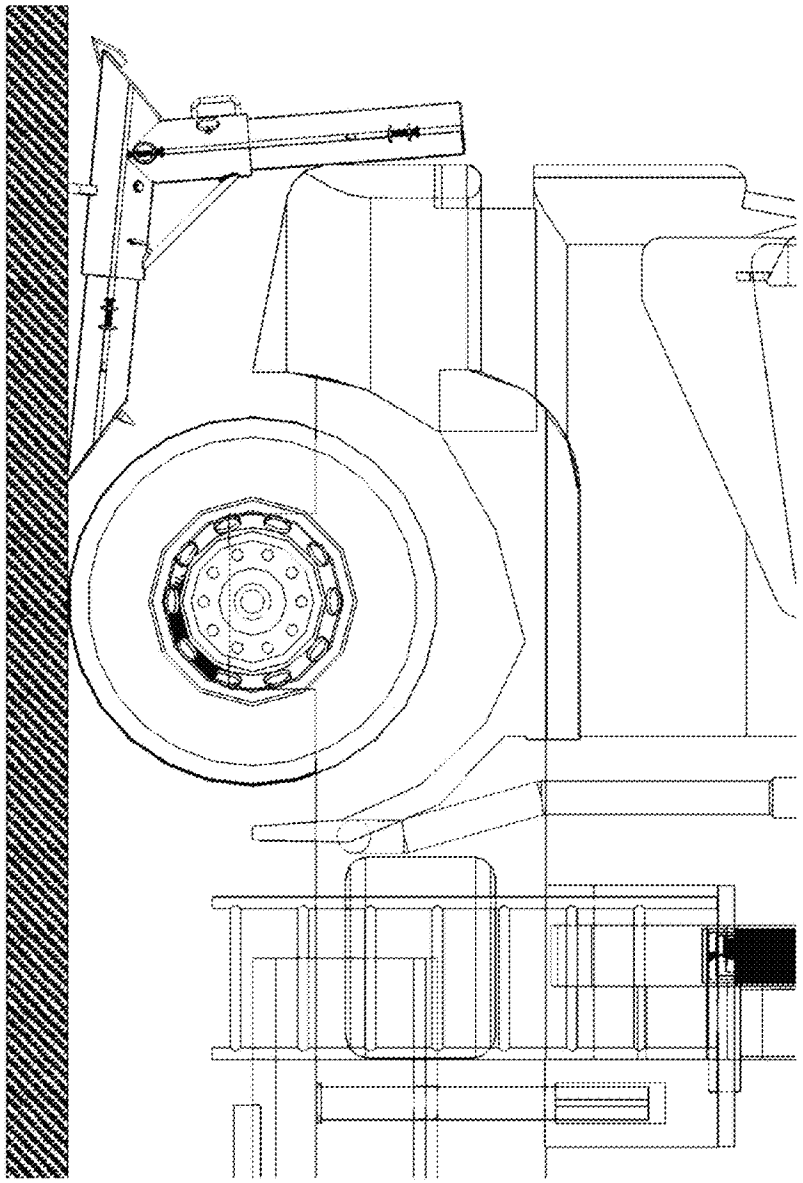
FIG. 7 shows a heavy goods vehicle approaching a device according to the present disclosure.
Figure 8:
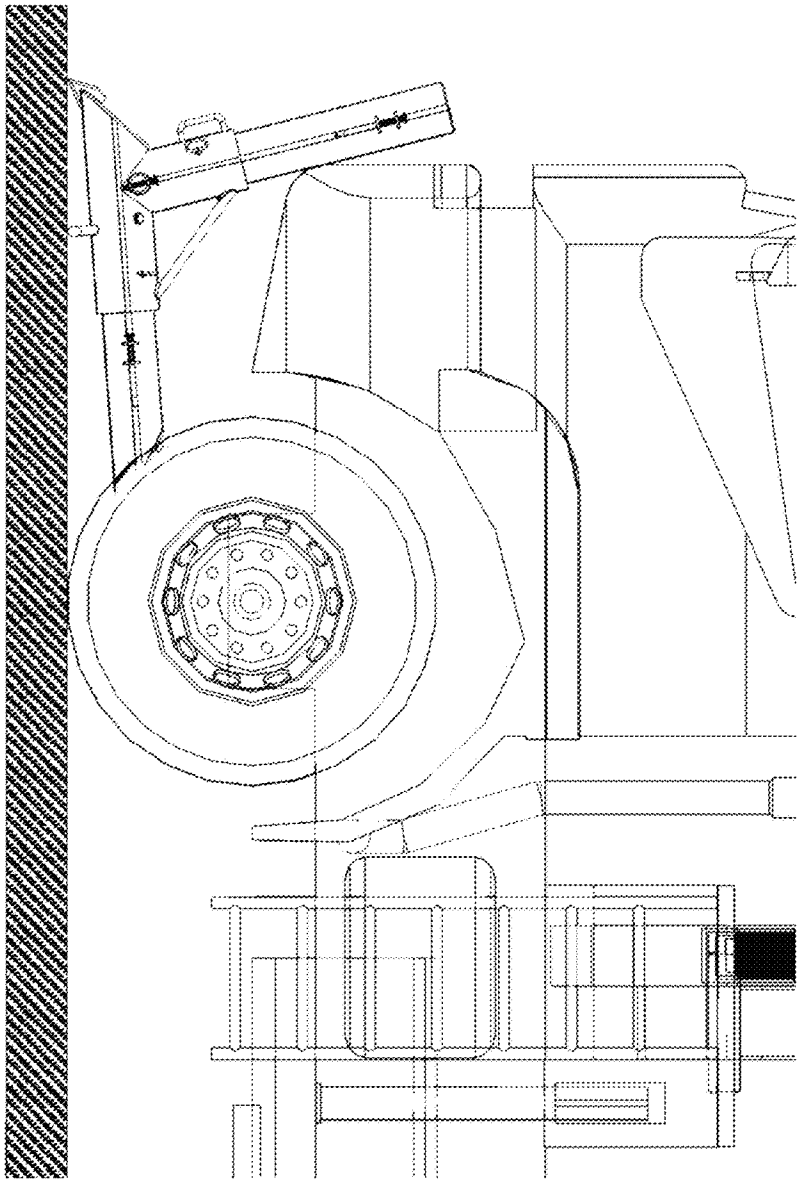
FIG. 8 shows a heavy goods vehicle pivoting an arresting bar/connector/pivot bar assembly according to the present disclosure.
Figure 9:
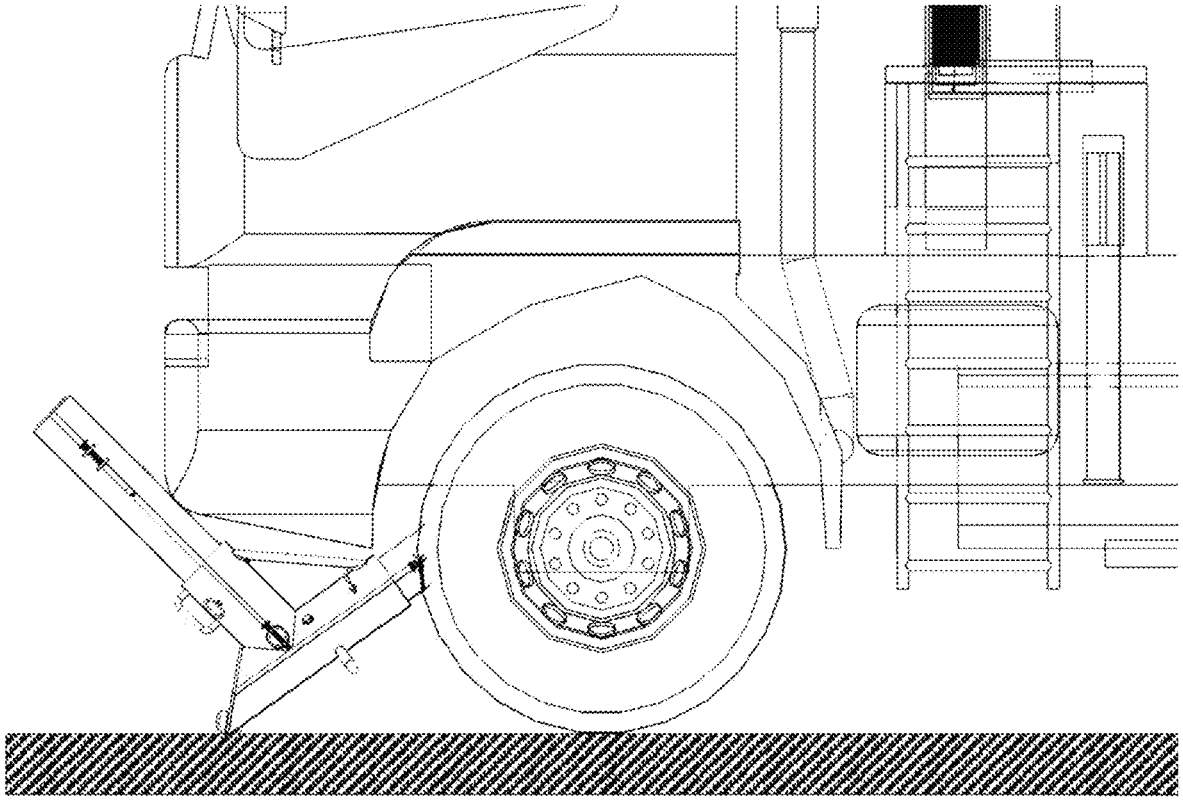
FIG. 9 shows a heavy goods vehicle that has pivoted the device of the present disclosure, the arresting bar pressing at one end against the ground and at the other end against the underside of the body, thus applying a maximum arresting force.

As shown in FIGS. 1 to 6, the present disclosure relates to an anti-ramming truck device comprising essentially horizontal arresting bars 3 fixed to pivot bars 5 (i.e. bars causing the device to pivot) forming, with the arresting bars 3, an angle $\alpha$ of at least 100°.

Essentially horizontal is to be understood as meaning that these bars are intended to be laid on the ground, one of the two ends being laid on the ground and the other end being either laid on the ground or slightly raised.

In contrast with the prior art that seeks to produce a vertical barrier that is held in that position by the weight of a vehicle on a base of the barrier, or that seeks to lift up the vehicle by way of a rotational movement of the barrier, the device of the present disclosure aims to use arresting bars 3 as stakes or spearheads that are on the one hand lodged in the ground by a spike 8 that penetrates the surface of the ground, and on the other hand lodged in the underside of the body of the vehicle by the impact of the vehicle with the elements of the device of the present disclosure.

Indeed, in the case of a heavy goods vehicle, it is ridiculous to suggest that the hinge of the devices of the prior art can have sufficient mechanical strength to stop a truck travelling at full speed. By contrast, a stake lodged in the underside of the body, rather than lifting up the truck, allows the greatest possible amount of kinetic energy to be absorbed, and the truck to be stopped more effectively. It is then clear that the more horizontal the stake (opposite the direction of movement) during the arresting phase, the more effective the system.

In order to arrive at this result, the device of the present disclosure seeks to facilitate pivoting of each element of the barrier. To that end, rather than using a vertical barrier, the pivot bars 5 are fixed to the arresting bars 3 at an angle of at least 100°, that is to say at least 10° greater than the angle of the prior art barriers. This angle is preferably between 100 and 135°. This inclination has two consequences. First, this inclination moves the center of gravity of the assembly backward, thus facilitating pivoting of the device; second, this angle makes it possible to increase the torque of rotation applied by the front of the truck on the system.

Advantageously, anchoring mechanisms comprising a spike 8 that is able to penetrate the surface of the ground when the device pivots as a consequence of a truck hitting the barrier are arranged at the end of or in line with the arresting bars to improve the stake effect thereof.

Preferably, anchoring mechanisms comprising essentially vertical spikes 7 that are able to penetrate the surface of the ground when the wheel of a truck presses on the system are arranged beneath the device so as to avoid it slipping.

Advantageously, the arresting bars 3, when the device is set up on a flat horizontal surface, are slightly inclined, the pivot bars 5 forming an angle of at least 100° with respect to the horizontal, this inclination being preferably obtained by way of supports 10 located slightly forward of the centre of gravity of the arresting bar 3/pivot bar 5 assembly or assemblies so as to facilitate pivoting of the assemblies.

In addition to those aspects of the device making it effective in terms of stopping ability, the device of the present disclosure must also be easy to set up and dismantle by a limited number of persons. To that end, the device can preferably be dismantled, the arresting bars 3 being removably fitted into connectors 6 into which the pivot bars 5 are removably fitted, the connectors maintaining a fixed angle of greater than 100° between the arresting bars 3 and the pivot bars 5.

Multiple arresting bar 3/connector 6/pivot bar 5 assemblies can be arranged parallel to one another and are connected to one another by way of crossbars 4. In this case, the crossbars will advantageously be dimensioned so as not to be too strong during an impact with a truck, in order that adjacent assemblies do not prevent movement of the other assemblies. In particular, it is important that an assembly facing a wheel, which will therefore be less able to pivot owing to the weight of the truck, does not prevent an adjacent assembly from pivoting and playing its stake part to stop the heavy goods vehicle.

From this point of view, it is also of interest to try to minimize the probability of a wheel of the truck mounting directly on top of the arresting bars 3, which would reduce their ability to pivot. To that end, it is advantageous for the upper face of the arresting bars 3 to have the smallest possible horizontal surface. For example, the use of square or lozenge-shaped cross sections arranged on-edge, as shown in FIGS. 3 to 6, urge the wheel of the truck to slide sideways, reducing the probability of pivoting being prevented by a wheel.

The device of the present disclosure can easily be dismantled and advantageously comprises n arresting bars 3, n being an integer greater than 1, n pivot bars 5, n connectors 6 and (n−1)*3 crossbars for fixing the adjacent bars 3, 5 and connectors 6.

The arresting bars 3 and the pivot bars 5 can be identical, reducing the number of different parts and thus making the system simpler to set up and dismantle.

The connectors can for example comprise two hollow metal arms welded to one another at an angle of greater than 100°, the arresting bars and pivot bars being fitted in a male/female-type assembly. A person skilled in the art will easily understand that, conversely, the bars can be hollow and the connectors fit into the bars.

Advantageously, the connectors comprise a strut 9 or a gusset plate 12 strengthening said connectors.

The ends of the arresting bars may also possibly comprise tire puncturing means or members 11. Preferably, the puncturing members are sized so that they can also pierce a metal sheet, such as a steel sheet, as those forming the engine crankcase or, more generally, the underside of a truck. Those piercing members allow an improvement of the stopping power of the barrier by fixing themselves to the truck underside.

The invention claimed is:

1. An anti-ramming truck device comprising:

one or more horizontal arresting bars (3);

one or more connectors (6); and one or more pivot bars (5) forming, with the one or more arresting bars (3) and in a vertical plane, an angle (α) of at least 100°, each of the one or more arresting bars (3) being rigidly connected to a corresponding pivot bar (5) in which each of the one or more arresting bars (3) are removably fitted into each one of the one or more connectors (6) and into which the one or more pivot bars (5) are removably fitted, each of the one or more connectors maintaining, in use, a fixed angle of greater than 100° between the one or more arresting bars (3) and the one or more pivot bars (5);

wherein each of the one or more arresting bars and corresponding connected one of the one or more pivot bars form a respective assembly;

wherein an inclination of each assembly is obtained by means of a respective support (10) configured to facilitate pivoting of the assembly; and wherein each support (10) comprises a pair of opposed legs, each leg of the pair of opposed legs extending at a non-vertical angle from a respective one of the one or more connectors (6).

2. The anti-ramming truck device according to claim 1, comprising anchoring means comprising essentially vertical spikes (7) that are able to penetrate the surface of the ground when a wheel of a truck presses on one or more of the one or more arresting bars.

3. The anti-ramming truck device according to claim 1, comprising additional anchoring means comprising a spike (8) that is able to penetrate the surface of the ground when the device pivots as a consequence of a truck hitting the device.

4. The anti-ramming truck device according to claim 1, in which the one or more pivot bars (5) form an angle ($\alpha$) of between 100 and 135° with respect to the one or more arresting bars (3).

5. The anti-ramming truck device according to claim 1, in which the one or more arresting bars (3), when the device is set up on a flat horizontal surface, are slightly inclined, the one or more pivot bars (5) forming an angle of at least 100° with respect to the horizontal.

6. The anti-ramming truck device according claim 1, in which multiple assemblies are arranged parallel to one another and are connected to one another by means of crossbars (4).

7. The device of claim 1, wherein each of the supports is located slightly forward of the center of gravity of each assembly.

8. The device of claim 1, wherein each of the connectors comprises two hollow metal arms welded to one another.

9. A kit for setting up an anti-ramming truck device according to claim 6, the kit comprising:

n arresting bars (3), n being an integer greater than 1;

n pivot bars (5);

n connectors (6) into which the arresting bars (3) and the pivot bars (5) fit; and (n−1)*3 crossbars for fixing adjacent bars (3,5) and connectors (6);

wherein each of the n arresting bars includes a respective support comprising a bifurcated pair of legs extending transversely from the respective arresting bar.

10. The kit according to claim 9, in which the arresting bars (3) and the pivot bars (5) are identical.

11. The kit according to claim 9, in which the connectors (6) comprise two hollow metal arms welded to one another at an angle of greater than 100°.

12. The kit according to claim 11, in which the metal arms have square or rhombus-shaped cross sections arranged such that a diagonal of the cross sections is vertical.

13. The kit according to claim 11, in which each of the connectors comprise a strut (9) or a gusset plate (12) strengthening each of said connectors.

14. An anti-ramming device comprising:

a plurality of arresting bars configured to rest on an underlying support surface, each of the plurality of arresting bars being coupled to a corresponding pivot bar by a respective connector to form a plurality of respective assemblies; and a crossbar coupled to the plurality of assemblies, wherein the crossbar is configured to fix the assemblies relative to each other;

wherein the connectors maintain a fixed angle of at least 100° between the arresting bars and the pivot bars;

wherein each assembly of the plurality of assemblies includes a support disposed adjacent a center of gravity of the assembly, such that the plurality of assemblies are configured to pivot on the supports with respect to the support surface when in use; and wherein each of the supports comprises a pair of legs, each leg extending laterally at a non-vertical angle.

15. The device of claim 14, wherein each support is disposed on the connector of each assembly such that the arresting bars are configured to have an inclined orientation with respect to the support surface.

16. The device of claim 14, wherein each of the supports is located slightly forward of the center of gravity of each respective assembly.

17. The device of claim 14, wherein the connector comprises two hollow metal arms welded to one another.

* * * * *